US006307944B1

(12) United States Patent
Garratt et al.

(10) Patent No.: US 6,307,944 B1
(45) Date of Patent: Oct. 23, 2001

(54) SYSTEM FOR MITIGATING RF INTERFERENCE IN A HEARING AID

(75) Inventors: Reginald G. Garratt, Burr Ridge; Elmer V. Carlson, Glenview, both of IL (US)

(73) Assignee: Knowles Electtronics LLC, Itasca, IL (US)

( * ) Notice: Subject to any disclaimer, the term of this patent is extended or adjusted under 35 U.S.C. 154(b) by 0 days.

(21) Appl. No.: 09/258,628

(22) Filed: Feb. 26, 1999

Related U.S. Application Data

(60) Provisional application No. 60/076,571, filed on Mar. 2, 1998.

(51) Int. Cl.[7] ..... H04R 25/00
(52) U.S. Cl. ..... 381/312
(58) Field of Search ..... 381/312, 313, 381/316, 317, 318, 319, 328, 94.1, 94.7, 122

(56) References Cited

U.S. PATENT DOCUMENTS 3,794,766 * 2/1974 Cox ..... 381/94.7
6,097,823 * 8/2000 Kuo ..... 381/318

FOREIGN PATENT DOCUMENTS 19545 760 C1 12/1995 (DE) .
19547 195 A1 6/1997 (DE) .
WO 98/08333 2/1998 (WO) .

* cited by examiner

*Primary Examiner*—Minsun Oh Harvey
(74) *Attorney, Agent, or Firm*—Wallenstein & Wagner, Ltd.

(57) ABSTRACT

A filter for a hearing aid is disclosed. The hearing aid comprises a microphone, an amplifier and a receiver. The filter mitigates the interfering effect of an RF burst on the hearing aid.

3 Claims, 6 Drawing Sheets

SYSTEM FOR MITIGATING RF INTERFERENCE IN A HEARING AID

RELATED APPLICATIONS

This application claims the benefit of U.S. Provisional Application No. 60/076,571, filed Mar. 2, 1998.

TECHNICAL FIELD

The present invention relates to hearings aids and, more particularly, to a system for mitigating the effect of RF interference on a hearing aid.

BACKGROUND OF THE INVENTION

Technical improvements in digital, cellular telephones using radio transmission have produced a problem for users of such cellular telephones who wear hearing aids. Early cellular telephone system implementations used a system called analog transmission and were not a serious problem. Each user had an exclusive radio channel. The subsequent need for more channels resulted in a technical change in the method of transmission. To obtain better utilization of the radio spectrum, systems were devised to gather signals during short periods of time and transmit the signals in much shorter bursts of radio energy. At the receiving end, this burst was expanded to its original length of time, resulting in a signal which sounded continuous. During the time between bursts, other callers could be using the same channel. To accomplish this, the radio transmitter had to be turned off between bursts. This intermittent radio transmission interferes with many electronic devices. While the analog cellular telephones also interacted with these devices, because it transmitted continuously, it only made a momentary disruption at the beginning and end of the call. If the information stream did not interact with the intended use of the device, it produced no real harm.

On the other hand, the improved transmission system turned the transmitter on and off at a rate that produced disruptions at a frequency that was quite audible to users of hearing aids. The rate of these disruptions for practical reasons was in the lower audible range. Such systems need to operate at pulse rates between tens of pulses per second to a few hundred pulses per second. There are at this time, systems pulsing at 50 times per second and at 217 times per second. While in use, the radio transmitter in the telephone handset must necessarily be in close proximity to the hearing aid, therefore, there is an intense radio frequency signal intercepting the hearing aid. This produces disturbances in the electronics of conventional hearing aids, which make their use impossible.

The problem in the hearing aid was the result of the radio frequency signals interacting with the semiconductor components in the hearing aid that are necessary for its operation. There are many avenues that this disruptive RF signal can enter the hearing aid circuitry. The conventional prior art methods ameliorating this problem are to prevent the entry of the radio signal to the sensitive portions of the hearing aid circuitry. Common approaches include shielding, reducing the sensitivity to radio frequency pick up by arranging the wiring and attenuating the propagation of the radio frequency as it approaches demodulating components in the hearing aid. These helped the hearing aid's performance, but frequently left an annoying residual buzz.

While the previously mentioned precautions are necessary, if a way could be devised to reduce the residual interference, the quality of the transmission could be improved.

DETAILED DESCRIPTION OF THE PREFERRED EMBODIMENT

Figure 1:
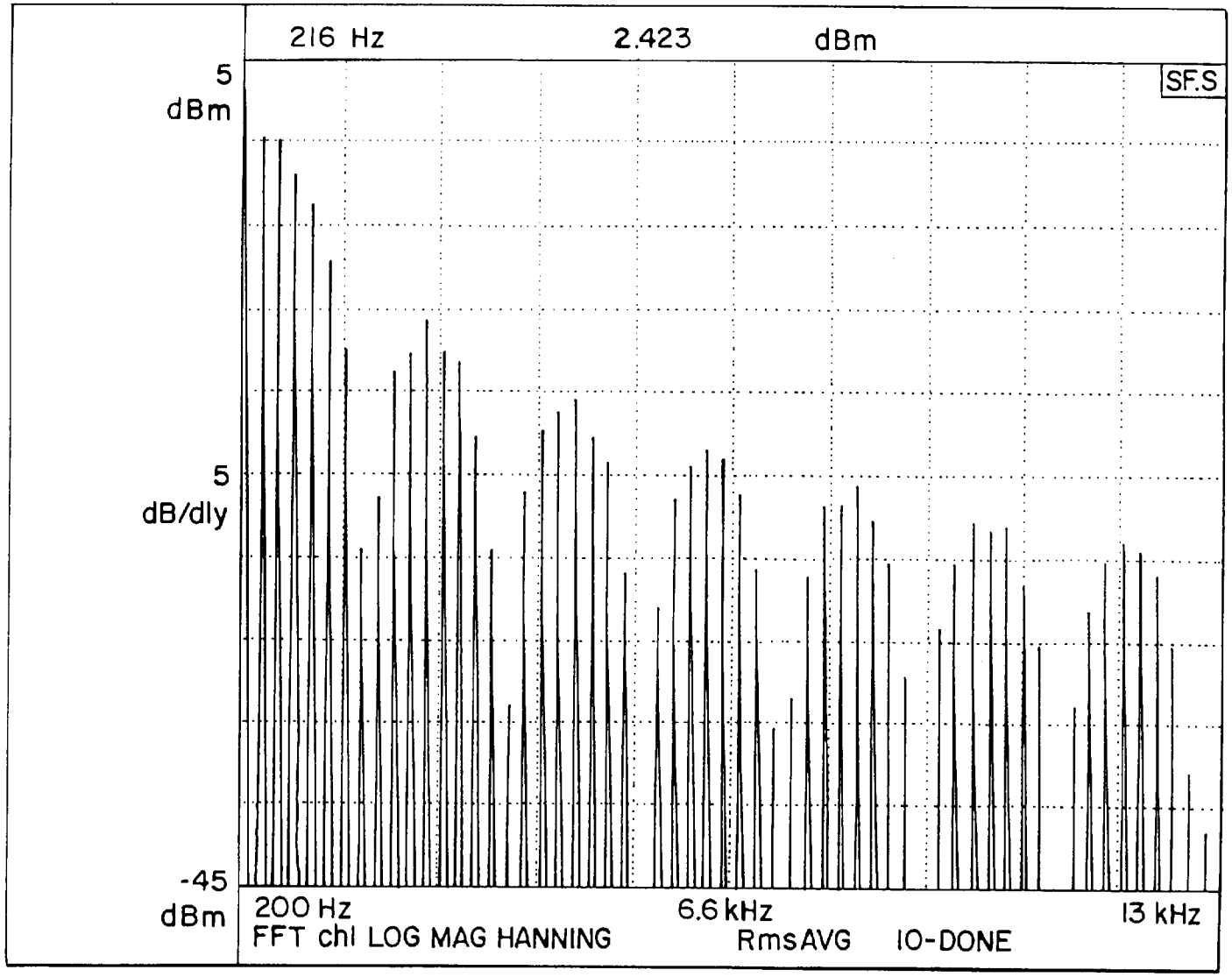
FIG. 1 is a frequency domain representation of the signal output of a typical digital cellular telephone.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

The realization of a method and apparatus by which these residual RF interferences could be attenuated is the subject of this invention. A hearing aid typically consists of a series of functions that describe its workings. First, a microphone receives the acoustic signal. This produces a weak electrical signal transmitted to an amplifier usually containing signal-crossing functions, which increase the magnitude of the signal. This is followed by a third function where this signal is routed to a receiver, which converts the signal into an amplified acoustic signal in the user's ear. It is at this point, if any remaining disruptive signal could be removed the quality of the signal could be improved.

Figure 2:
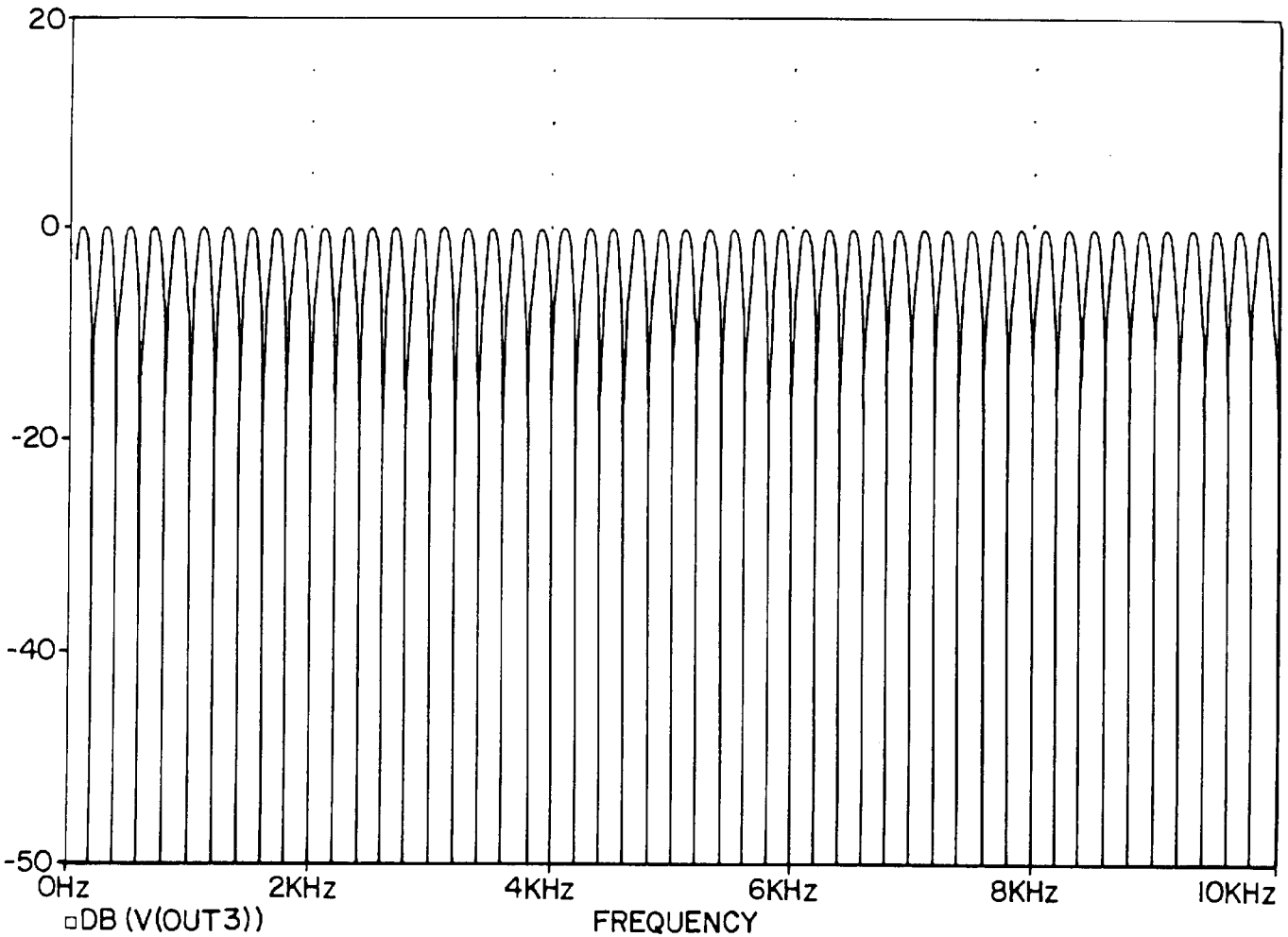
FIG. 2 is a frequency domain representation of a comb filter.

It is necessary to understand the nature of this unwanted component of the signal. The unwanted component results from the handset transmitter being turned on and off repeatedly for very short times separated by longer spacing intervals. In electrical terms, this resolves into a signal having frequency components that are harmonics (multiples) of this repetition rate. A spectrum representing these frequencies is illustrated in FIG. 1. In accordance with the invention, a filter is provided to suppress these harmonic frequencies, and the effective quality of the desired signal transmission is improved. These interfering signals are rigid in their arrangement, and the signal processing used for the therapeutic aims of the hearing aid does not change their frequencies. The filter that will suppress such an array is known as a "comb" filter, because the plot of transmission characteristics produces a series of low transmission frequencies at regular intervals, creating the visual impression of a comb. See FIG. 2. The object is to make these attenuated transmission frequencies coincide with the frequencies of the disruptive signals, while letting the desired signal pass relatively unimpeded.

Figure 3:
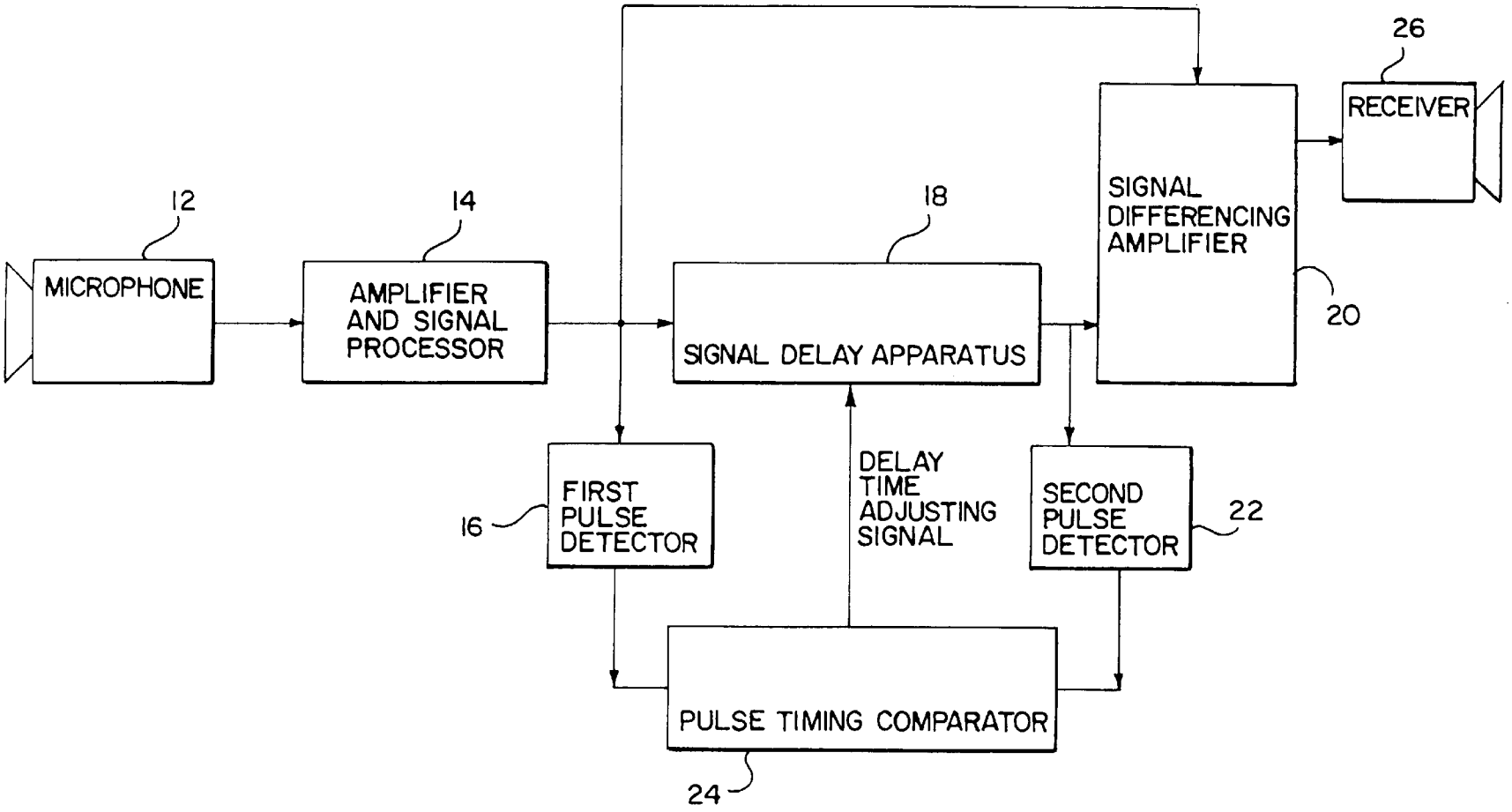
FIG. 3 is a block diagram of an apparatus for mitigating RF interference in a hearing aid in accordance with the present invention.

FIG. 3 is a block diagram of one arrangement that produces the desired result. Sound enters the microphone 12, and is converted to an electrical signal. The electrical signal is passed on to the amplifier and signal processor 14 to perform the normal functions of the hearing aid. If there is an offending digital cellular telephone handset in operation near this hearing aid, or some other similarly offending device, the RF bursts from the telephone will be rectified in the semiconductors, if the defensive measures in the hearing aid mentioned earlier are not completely effective. The RF burst will then create reoccurring pulses in the signal string being fed to a first pulse detector 16, a signal delay apparatus 18 and a signal differencing amplifier 20. After the pulse traverses the signal delay apparatus 18, it will be again be recognized by a second pulse detector 22. If the pulse from the next burst arrives from the first pulse detector 16 at the same time as the first pulse arrives at the pulse timing detector, the time delay will be as desired. If they are not coincident, a pulse timing comparator 24 applies a correction to the signal delay apparatus 18 to make the delay for the next pair of pulses coincident.

When the two consecutive pulses arrive simultaneously at the signal differencing amplifier 20, being equal or very nearly equal, they cancel the first pulse as a component of the signal to the receiver. The signal, unless it is repeating at the same rate as the pulses, will be different and is not canceled. Some information is lost, but enough is retained to leave an improved signal at the output 26 of the hearing aid.

It is contemplated that the filter would be located within the hearing aid, potentially within the receiver itself. Although the filter is shown in block diagram fort in FIG. 3, those skilled in the art will readily realize that the present invention can be implemented as a program for controlling the operation of a digital signal processor within a hearing aid.

Figure 4:
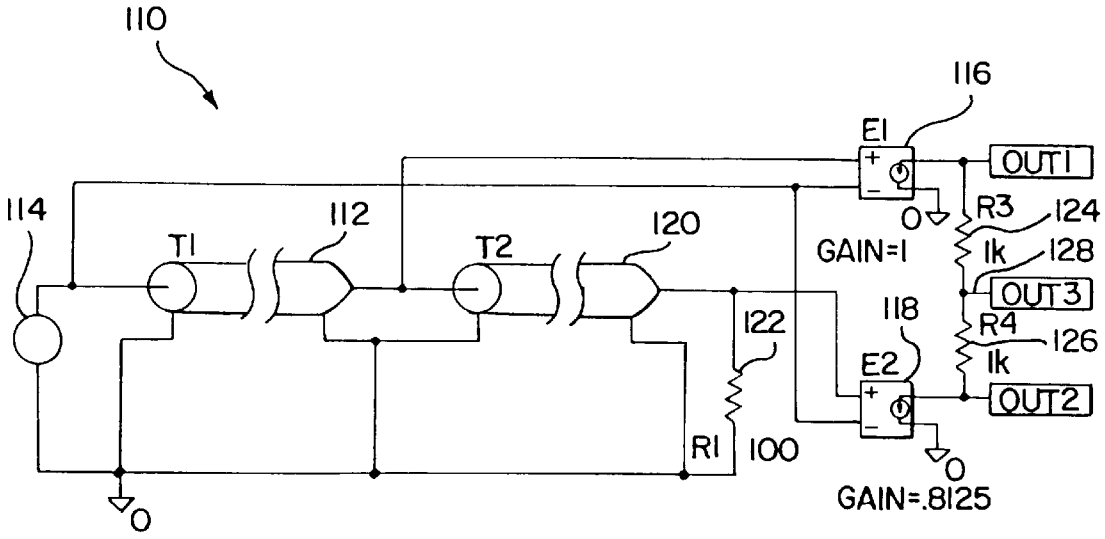
FIG. 4 is a simplified schematic diagram of another embodiment of an apparatus for mitigating RF interference.
Figure 5:
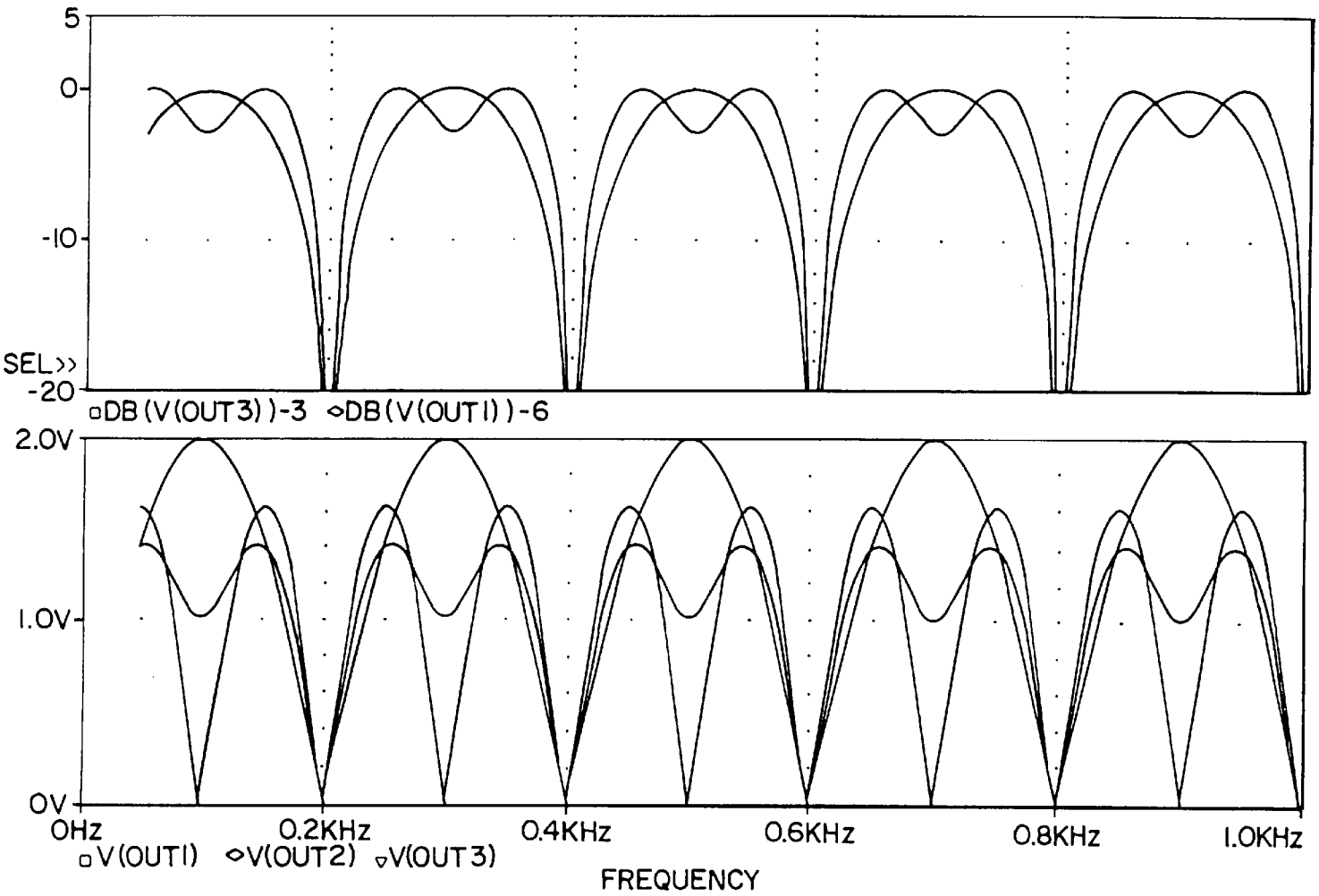
FIG. 5 illustrates the frequency response of the various outputs of the apparatus shown in FIG. 4.

Turning to FIG. 4, a simplified schematic diagram is depicted of another embodiment of an apparatus for mitigating RF interference. In particular, the device 110 includes two delay lines to increase bandwidth and provide a mid-point tap. The input of the first delay line 112 is operably coupled to a microphone 114 and the inverting inputs of a first amplifier 116 and a second amplifier 118 having preferred gains of about 1 and 0.8125, respectively. The output of the first delay line 112 is operably coupled to the input of the second delay line 120 and the non-inverting input of the first amplifier 116. The output of the second delay line 120 is operably coupled to the non-inverting input of the second amplifier 118 and a pull-down resistor 122 tied to ground with a resistance of about 100 ohms. Coupled between the outputs of the amplifiers 116,118 are a pair of serially connected resistors 124,126 having individual resistance values of about 1000 ohms each. As shown in FIG. 5, the frequency response of the various outputs of the device 110 are depicted wherein the RF interference is substantially mitigated at the output 128 between the serially connected resistors 124,126.

Figure 6:
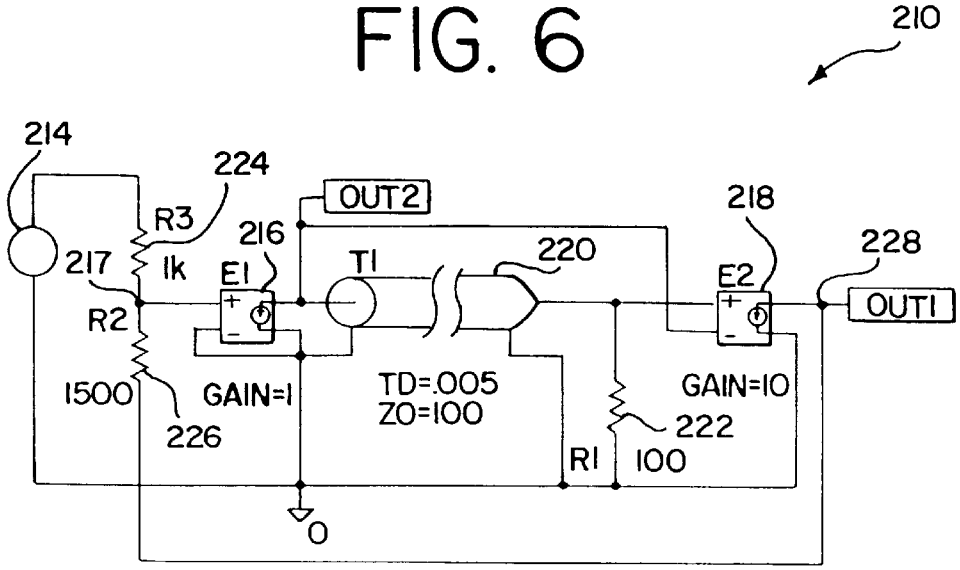
FIG. 6 is a simplified schematic diagram of yet another embodiment of a device for mitigating RF interference in a hearing aid.

Turning to FIG. 6, a simplified schematic diagram is depicted of another embodiment of a filter device 210 for mitigating RF interference that uses only one delay line 220. In this embodiment, a pair of serially connected resistors 224,226 are coupled between a microphone 214 and the output of a second amplifier 218. The resistors 224 and 226 preferably have resistance values of about 1000 and 1500 ohms, respectively.

Coupled to the junction 217 between the resistors 224,226 is the non-inverting input of a first amplifier 216 with its inverting input attached to ground and having a preferred gain of about 1. The output of the first amplifier 216 is attached to the input of the delay line 220 and the inverting input of the second amplifier 218. The output of the delay line 220 is coupled to the non-inverting input of the second amplifier 218 and a pull down resistor 222 tied to ground. Preferably, the second amplifier 218 has a gain of about 10 and the resistor 222 has a resistance value of about 100 ohms.

In FIG. 6, all signals from the microphone 214 pass through the filter device 210 to provide continuous filtering. Thus, comb filtering is always achieved.

In particular, the first amplifier 216 drives the filter wherein the output 228 of the filter is summed with the input signal from the microphone 214 by an amount determined by the resistance values of resistors 224 and 226. Accordingly, the signal arriving from the output 228 and through resistor 226 is similar to a negative feedback amplifier for producing flat responses. Thus, device 210 flattens the response by increasing the transmission near the comb frequencies, but the notch frequencies cannot reach the output terminal 228.

Figure 7:
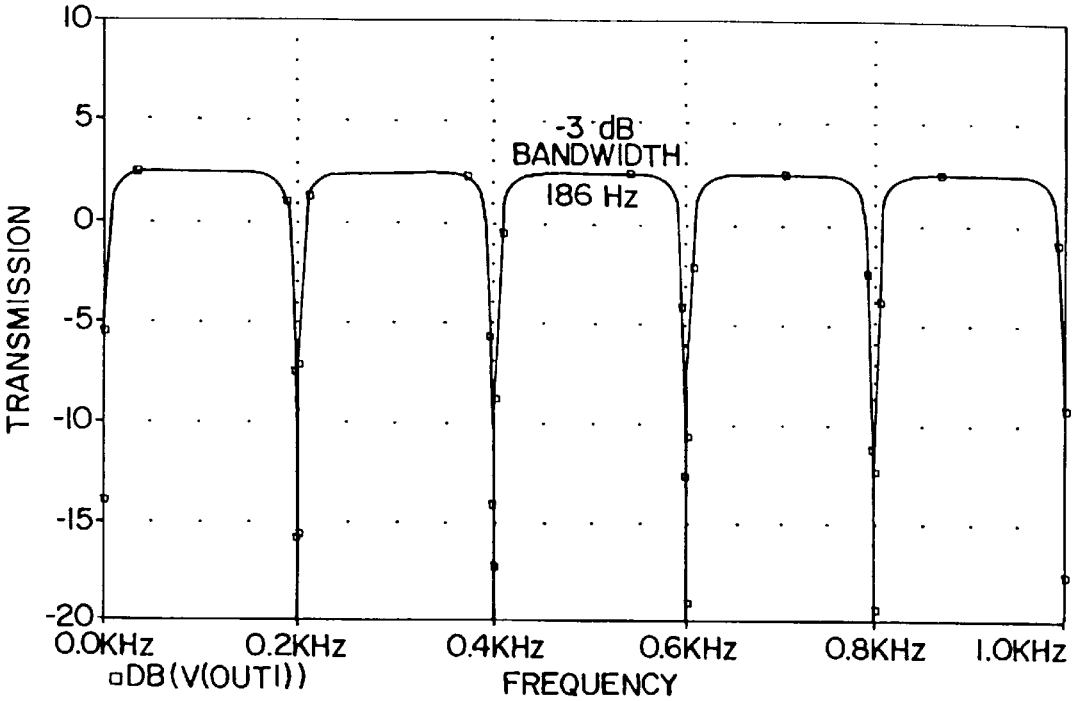
FIG. 7 depicts the frequency response of the device of FIG. 6.
Figure 8:
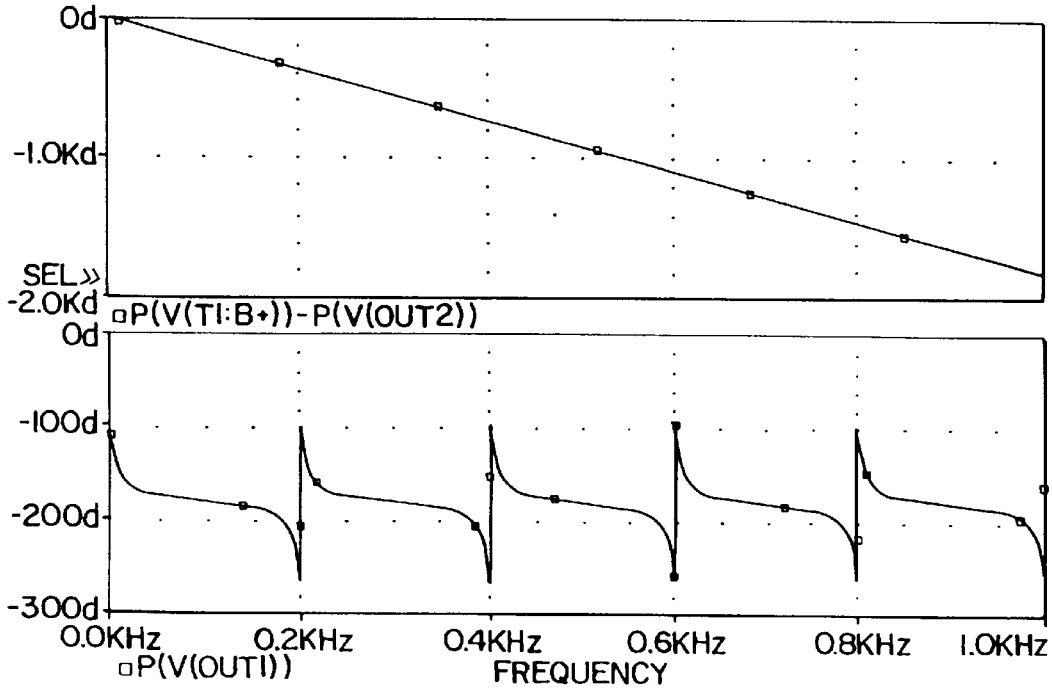
FIG. 8 is a phase plot of the device of FIG. 6.

The result of the filtering by device 210 is depicted in FIGS. 7 and 8 wherein, for convenience, the device is set to 200 Hz rather than the desired frequency of 217 Hz. In particular, FIG. 7 depicts the frequency response of the device 210 at output 228. Further, FIG. 8 provides a phase plot of the device 210.

While the specific embodiment has been illustrated and described, numerous modifications come to mind without significantly departing from the spirit of the invention and the scope of protection is only limited by the scope of the accompanying Claims.

We claim:

1. For a hearing aid comprising a microphone, an amplifier and a receiver, a filter for mitigating the interfering effect of an RF burst, the filter comprising:

a signal delay apparatus;

a signal differencing amplifier;

a first pulse detector;

a pulse timing comparator; and, a second pulse detector, wherein an RF burst creates reoccurring pulses in a signal sting being fed to said first pulse detector, said signal delay apparatus and said signal differencing amplifier, said burst being subsequently recognized by said second pulse detector; and said pulse timing comparator determines if the pulse from the next burst arrives from the first pulse detector at the same time as the first pulse arrives at the pulse timing detector, and the signal delay apparatus responds to the pulse timing comparator, the time delay is as desired, to maintain the time delay, but if they are not coincident, the pulse timing comparator applies a correction to the signal delay apparatus to make the delay for the next pair of pulses coincident.

2. The filter of claim 1 disposed within a hearing aid.

3. The filter of claim 1 disposed within said hearing aid receiver.

* * * * *